US010595606B1

(12) United States Patent
Tong

(10) Patent No.: US 10,595,606 B1
(45) Date of Patent: Mar. 24, 2020

(54) DUAL-BUTTON HANDLE GRIP FOR RETRACTABLE LUGGAGE HANDLE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 16/299,005

(22) Filed: Mar. 11, 2019

(51) Int. Cl.
*A45C 13/26* (2006.01)
*A45C 5/03* (2006.01)

(52) U.S. Cl.
CPC ..... *A45C 13/26* (2013.01); *A45C 5/03* (2013.01)

(58) Field of Classification Search
CPC ..... A45C 13/26; A45C 5/03
See application file for complete search history.

(56) References Cited

U.S. PATENT DOCUMENTS 5,984,064 A 11/1999 Byington
6,061,871 A * 5/2000 Wang ..... A45C 13/262 16/113.1
6,223,391 B1 * 5/2001 Kuo ..... A45C 13/262 16/113.1
6,374,457 B1 * 4/2002 Kuo ..... A45C 13/262 16/113.1
6,550,102 B1 * 4/2003 Liang ..... A45C 13/262 16/113.1
6,920,666 B1 * 7/2005 Chen ..... A45C 13/262 16/113.1
7,188,715 B1 * 3/2007 Chen ..... A45C 13/262 16/113.1
7,200,896 B1 * 4/2007 Chen ..... A45C 13/26 16/113.1
7,658,269 B2 2/2010 Wu
8,726,464 B1 * 5/2014 Tong ..... A45C 13/262 16/113.1
9,861,172 B1 * 1/2018 Wang ..... A45C 13/26
2002/0014382 A1 * 2/2002 Kuo ..... A45C 13/262 190/115
2003/0006111 A1 * 1/2003 Huang ..... A45C 13/262 190/115
2010/0251517 A1 * 10/2010 Lai ..... A45C 13/262 16/113.1
2010/0313383 A1 * 12/2010 Lai ..... A45C 13/262 16/113.1
2013/0233662 A1 * 9/2013 Sener ..... A45C 13/262 190/115
2013/0313058 A1 * 11/2013 Yoshida ..... A45C 5/14 190/18 A

* cited by examiner

*Primary Examiner* — Jason W San
(74) *Attorney, Agent, or Firm* — Pai Patent & Trademark Law Firm; Chao-Chang David Pai

(57) ABSTRACT

A dual-button handle grip includes a grip body joined to respective top ends of two retractable bars of a luggage and provided with an oblique button hole at each of two ends thereof, two press buttons respectively movably mounted in the button holes and respectively providing a first push surface and a second push surface at the bottom side, two sliding bars horizontally mounted in the grip body, and two sliding blocks vertically slidably disposed in the grip body for moving respective linkage rods in the retractable bars. When one press button is pressed, the first push surface and the second push surface are forced to push the sliding bars and the sliding blocks, causing the sliding blocks to move the respective linkage rod synchronously in activating the respective locking mechanisms.

10 Claims, 7 Drawing Sheets

DUAL-BUTTON HANDLE GRIP FOR RETRACTABLE LUGGAGE HANDLE

BACKGROUND OF THE INVENTION

(a) Field of the Invention

The present invention relates to luggage handle technology and more particularly to a dual-button handle grip for retractable luggage handle that allows the user to unlock the retractable handle of the luggage by pressing either one of two buttons.

(b) Description of the Prior Art

A luggage is generally provided with a retractable handle on the back side, and the upper end of the retractable handle is combined with a grip. The grip is provided with an unlocking mechanism capable of controlling the linkage rod and the locking mechanism of the retractable handle, so that the retractable handle can be pulled out or contracted. Nowadays, the unlocking mechanism for retractable luggage handle has many types. One of the unlocking mechanisms includes an unlocking button at each end of the grip, such as the one described in U.S. Pat. No. 7,658,269B2, U.S. Pat. No. 7,188,715B1, U.S. Pat. Nos. 5,984,064A, and 8,726,464B1. However, a retractable luggage handle generally includes two retractable bars.

Therefore, an unlocking button should be provided at both ends of the grip. It is necessary to enable the interlocking lever and the lock in each of the two retractable bars to be synchronously moved for the retractable handle to be pulled out of the retracted position when the unlocking button on either end is pressed by the user.

U.S. Pat. No. 7,658,269B2 discloses a handle of a two pulling rod suitcase that includes a handle body including a casing pivotably disposed with a hinge member that is disposed with a tooth portion at the outside thereof, and a pulling rod device including two pulling rod units and a transmission member. The hinge member is connected with a spring for return. The casing at least includes first and second connecting members at opposite sides thereof that mated with the tooth portion. Outer ends of the first and second connecting members are respectively disposed with first and second pressing members. Each pulling rod member includes at least one pulling rod. The transmission member is pivotably disposed in the pulling rod. The transmission member is connected with the first and second connecting members or the first and second pressing members. This design is complicated, not easy to manufacture or assemble.

U.S. Pat. No. 7,188,715B1 discloses a pull handle, in which two external gliding bases are respectively movable by two buttons. When the two external gliding bases are moved horizontally, they push a balance pressure bar below to squeeze two transmission blocks, causing the two transmission blocks to press two linkage bars, thereby synchronously driving the rotary bars and the fixation pins to unlock the pull handle for allowing adjustment of the angle of grip handle. According to this design, the applied pressure is transferred through two external gliding bases, a balance pressure bar and two transmission blocks to two linkage bars. This structure of this design of pull handle is complicated. Further, multiple conversion of kinetic energy transfer is easy to cause pressure loss.

SUMMARY OF THE INVENTION

The present invention has been accomplished under the circumstances in view. It is one object of the present invention to provide a dual-button handle grip for retractable luggage handle, which comprises a grip body joined to respective top ends of two retractable bars of a luggage and provided with an oblique button hole at each of two ends thereof, two press buttons respectively movably mounted in the button holes and respectively providing a first push surface and a second push surface at the bottom side, two sliding bars horizontally mounted in the grip body, and two sliding blocks vertically slidably disposed in the grip body for moving respective linkage rods in the retractable bars. When one press button is pressed, the first push surface and the second push surface are forced to the sliding bars and the sliding blocks, causing the sliding blocks to move the respective linkage rod synchronously in activating the respective locking mechanisms.

The internal linking mechanism of the dual-button handle grip of the present invention can synchronously control the linkage rods and locking mechanisms in the two retractable bars of the luggage without needing to use gears and racks, or any other complicated structure, thus achieving simple structure, ease of manufacturing and assembling and cost reduction.

Other advantages and features of the present invention will be fully understood by reference to the following specification in conjunction with the accompanying drawings, in which like reference characters denote like components of the structure.

DETAILED DESCRIPTION OF THE PREFERRED EMBODIMENTS

Figure 1:
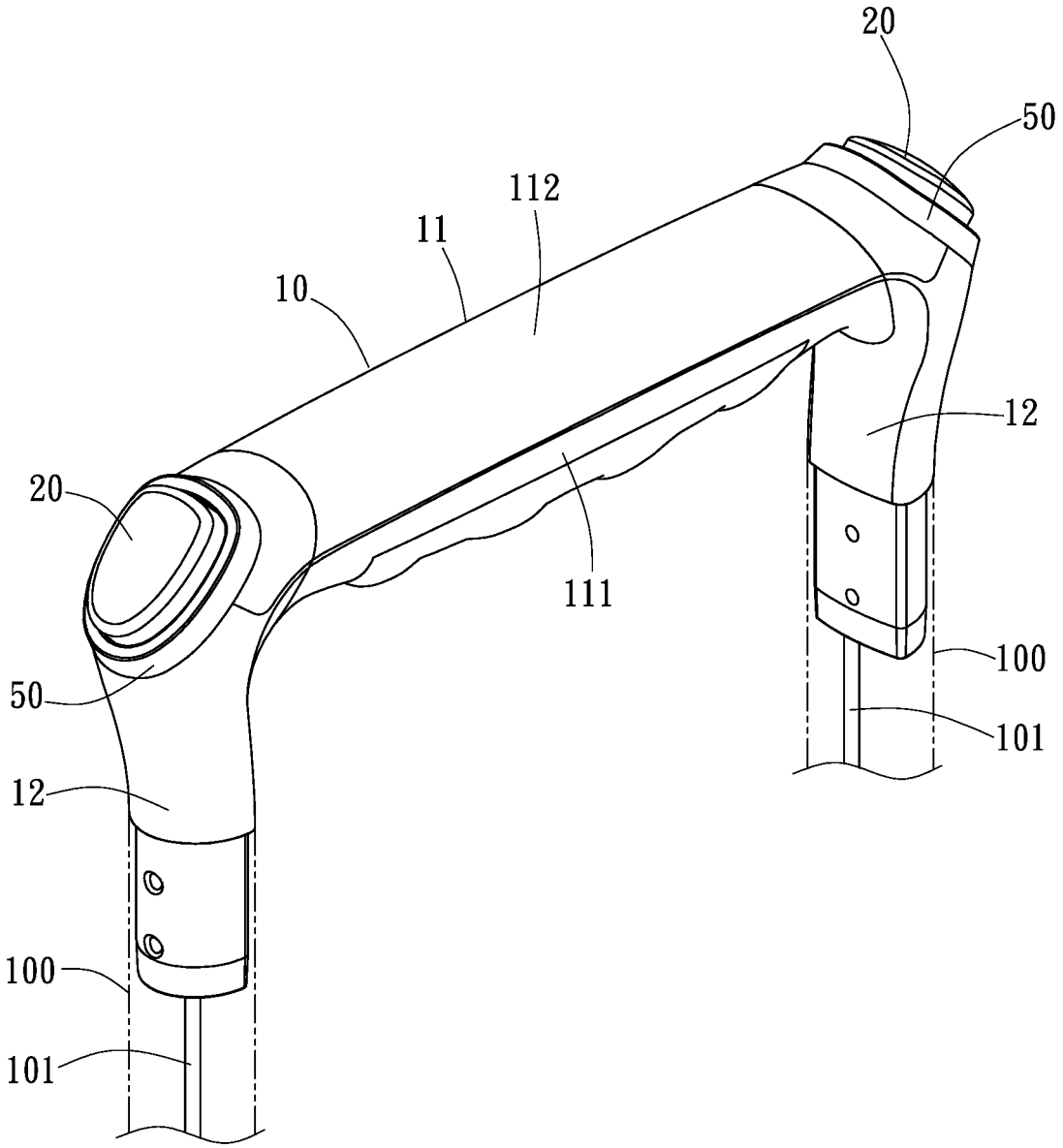
FIG. 1 is an oblique top elevational view of a dual-button handle grip for retractable luggage handle in accordance with the present invention.
Figure 2:
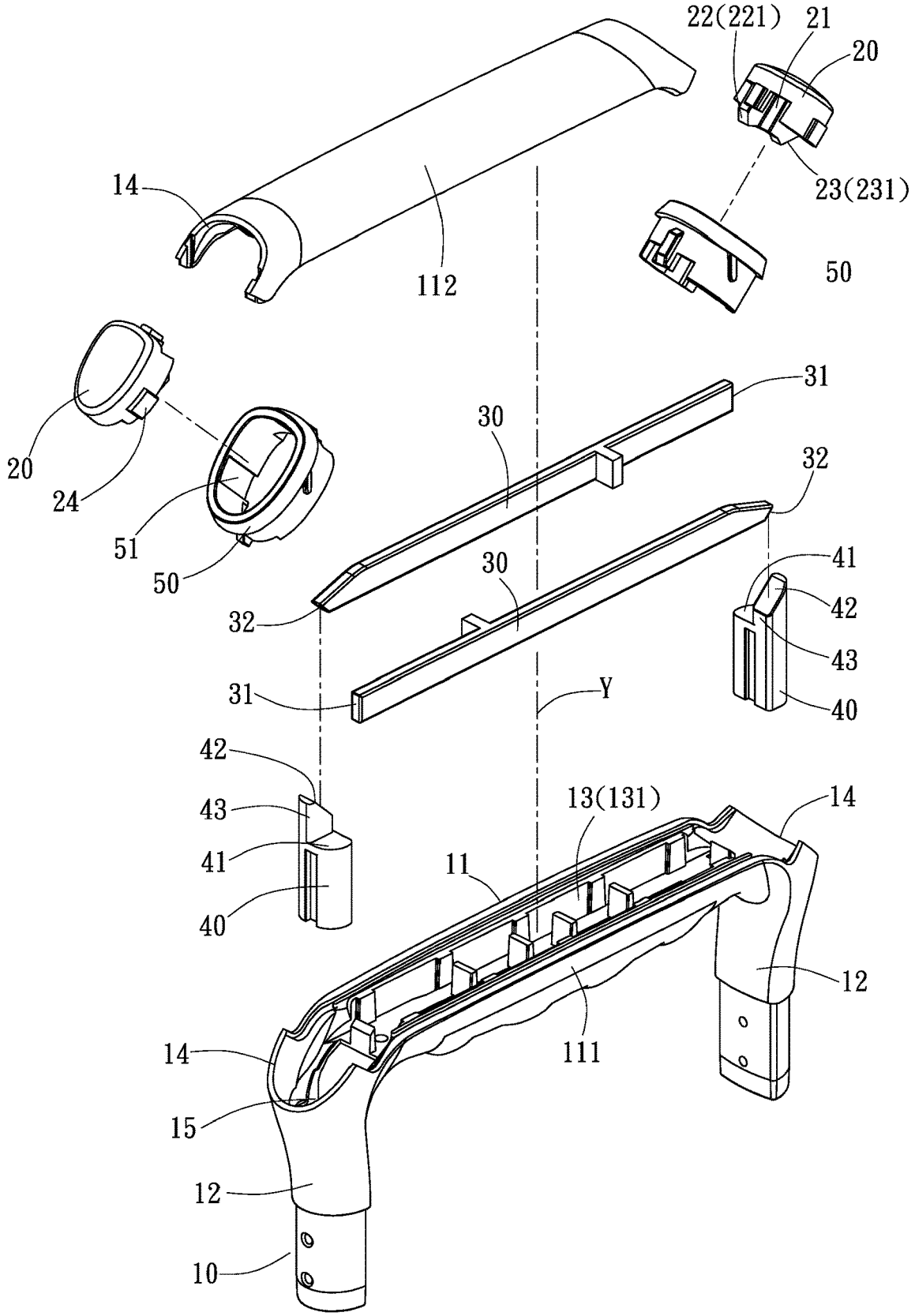
FIG. 2 is an exploded view of the dual-button handle grip in accordance with the present invention.
Figure 3:
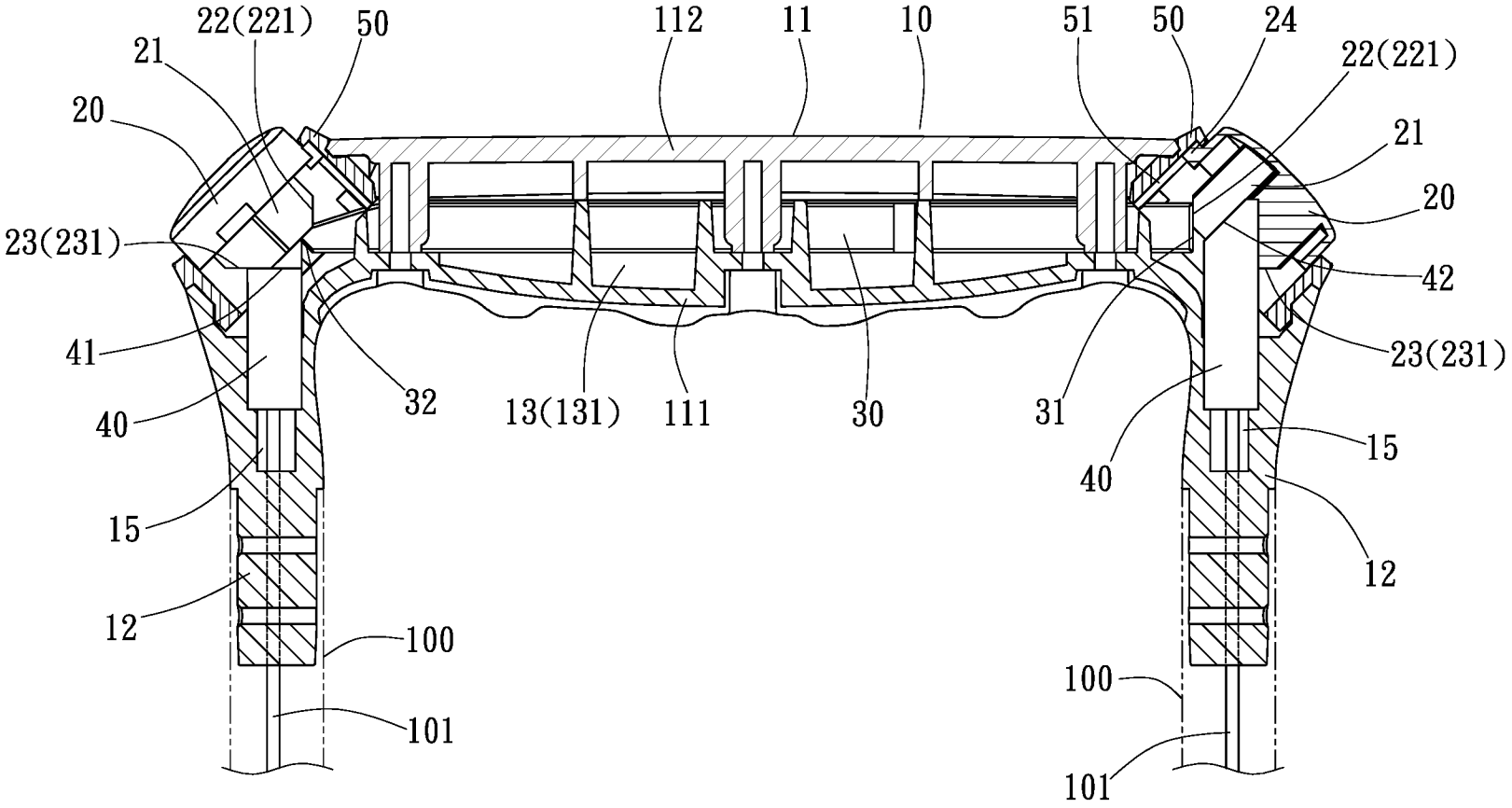
FIG. 3 is a sectional side view of the dual-button handle grip in accordance with the present invention.

Referring to FIGS. 1, 2 and 3, a dual-button handle grip is joined to a top end of two retractable bars 100 of a luggage (not shown). Physically, the dual-button handle grip comprises a plastic injection molded grip body 10, two press buttons 20, two sliding bars 30, and two sliding blocks 40.

The grip body 10 comprises a horizontal grip bar 11, and two mounting bars 12 respectively vertically connected to two opposite ends of the horizontal grip bar 11. The horizontal grip bar 11 has a first internal chamber 13 defined therein, and a button hole 14 obliquely upwardly located on each of two opposite ends thereof and disposed in communication with the first internal chamber 13. The mounting bar 12 is mounted on a top end of one respective retractable bar 100, having a second internal chamber 15 defined therein and disposed in communication with the first internal chamber 13.

Figure 6:
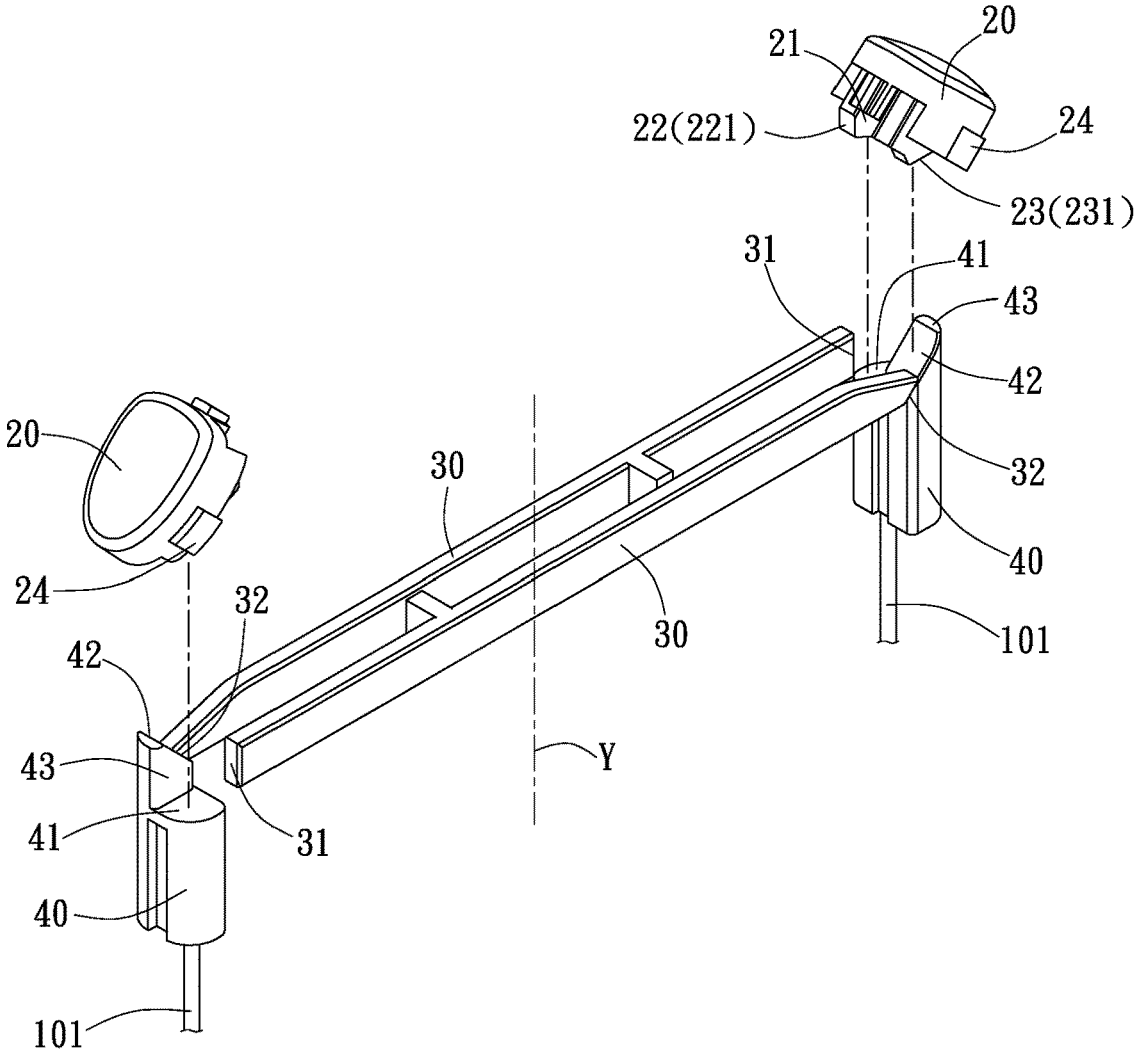
FIG. 6 is a schematic drawing of the present invention, illustrating the relationship between the two press buttons, the two sliding bars and the two sliding blocks.
Figure 7:
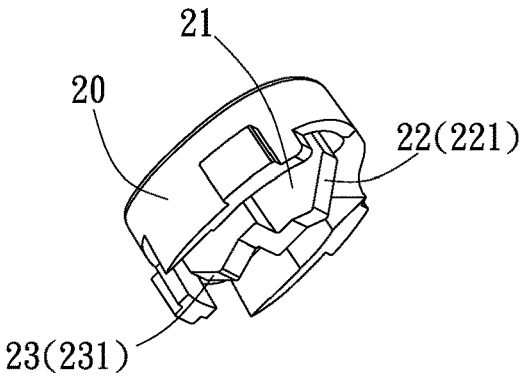
FIG. 7 is an oblique elevational view of the press button.
Figure 8:
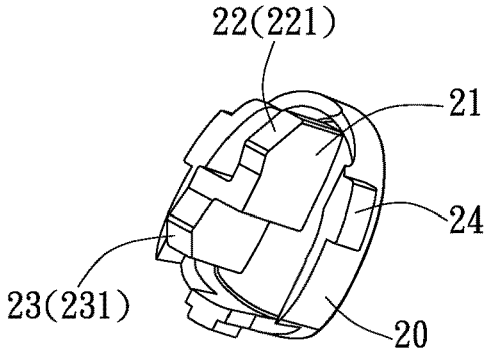
FIG. 8 corresponds to FIG. 7 when viewed from another angle.

As illustrated in FIG. 2 and FIG. 3, the two press buttons 20 are respectively movably mounted in the two button holes 14. Each press button 20 has a bottom end thereof inserted into the first internal chamber 13. Referring also to FIG. 6, FIG. 7 and FIG. 8, each press button 20 has a push block 21 at a bottom side thereof. The push block 21 has a first push surface 22 facing the first internal chamber 13, and a second push surface 23 facing the second internal chamber 15. When the press button 20 is pressed, the first push surface 22 is moved toward the first internal chamber 13, and at the same time, the second push surface 23 is moved toward the second internal chamber 15.

Figure 4:
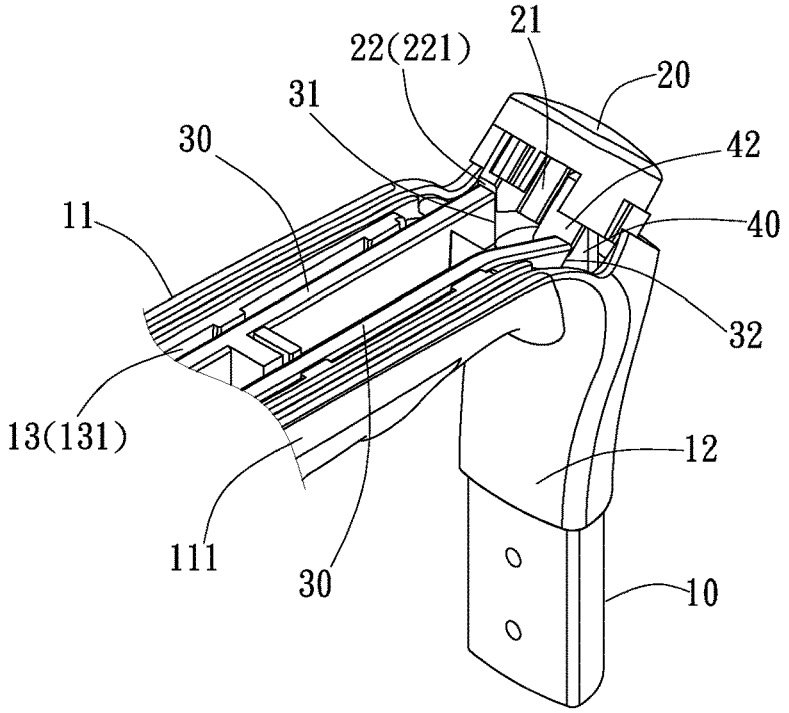
FIG. 4 is a schematic elevational view of a right part of the dual-button handle grip in accordance with the present invention.
Figure 5:
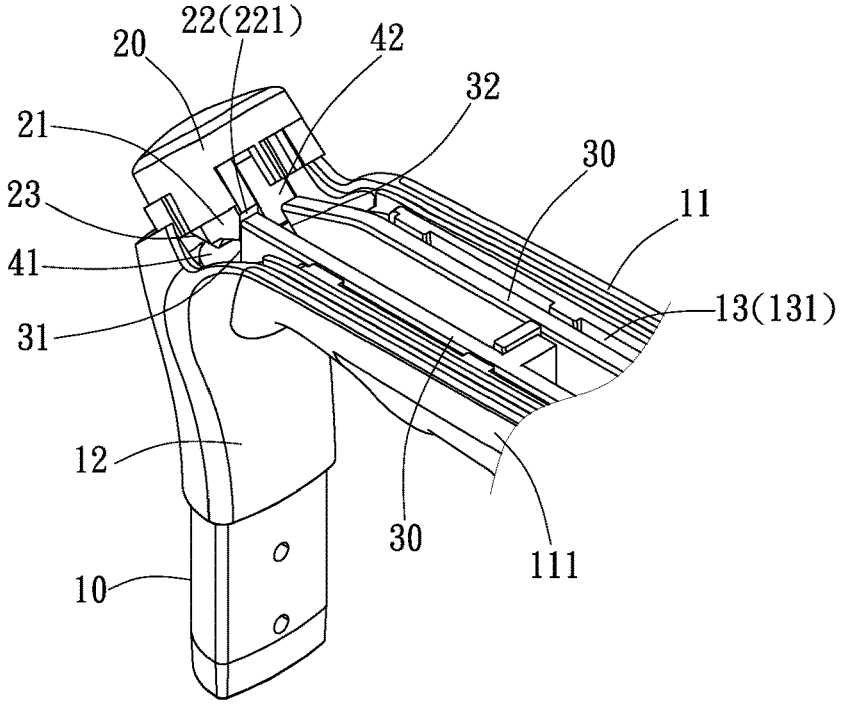
FIG. 5 is a schematic elevational view of a left part of the dual-button handle grip in accordance with the present invention.

The two sliding bars 30 are elongated bars arranged in parallel and horizontally slidably disposed in the first internal chamber 13. The two sliding blocks 40 are respectively and vertically movably mounted in the second internal chambers 15 of the respective mounting bars 12. The two sliding bars 30 each have respective first ends thereof respectively abutted against the first push surfaces 22 of the respective press buttons 20 (see FIG. 4 and FIG. 5) and opposing second ends thereof respectively abutted against the respective sliding blocks 40 (see FIG. 6). The sliding blocks 40 have respective top ends thereof respectively abutted against the second ends of the respective sliding bars 30 and the second push surfaces 23 of the respective press buttons 20 (see FIG. 6), and respective opposing bottom ends thereof respectively connected to a respective linkage rod 101 in the respective retractable bar 100.

Figure 9:
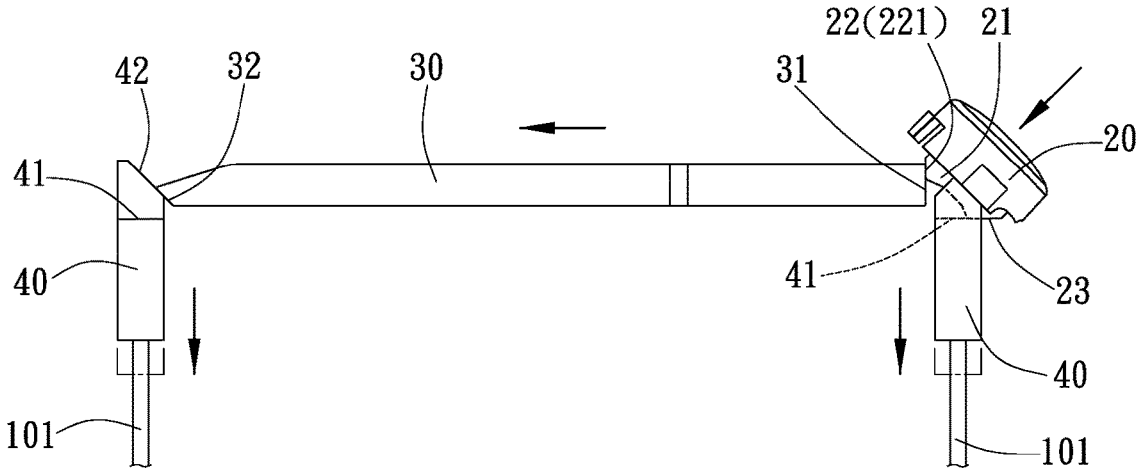
FIG. 9 is a schematic operational view of the present invention, illustrating the right-sided press button pressed.
Figure 10:
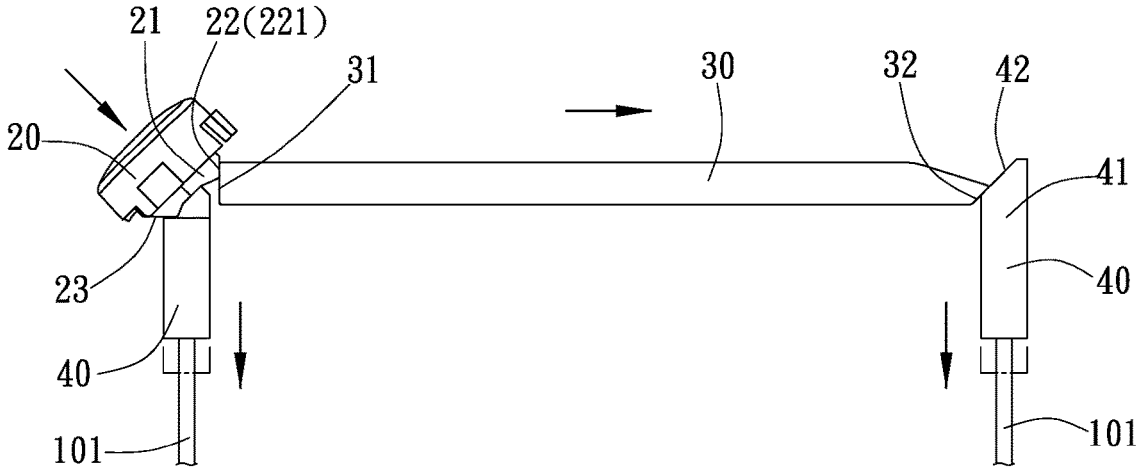
FIG. 10 is a schematic operational view of the present invention, illustrating the left-sided press button being pressed.

Referring to FIG. 9 and FIG. 10, when one of the two press buttons 20 is pressed by the user, the first push surface 22 of the pressed press button 20 pushes the first end of the respective sliding bar 30, causing the respective sliding bar 30 to slide. Thus, the second end of the sliding bar 30 in sliding pushes the respective sliding block 40. At the same time, the second push surface 23 of the pressed press button 20 pushes the other sliding block 40, causing the two sliding blocks 40 to synchronously move the linkage rods 101 downward in activating the respective locking mechanisms (not shown) in the respective retractable bars 100 for allowing adjustment of the length of the retractable bars 100.

Referring to FIGS. 2 and 6 again, the first push surface 22 of the press button 20 is a first vertical surface 221 parallel to the vertical center line Y of the grip body 10; the second push surface 23 of the press button 20 is a first horizontal surface 231 perpendicular to the vertical center line Y of the grip body 10. The two sliding bars 30 each have a second vertical surface 31 located on the first end thereof to mate with the first push surface 22. Each sliding bar 30 have a first bevel surface 32 located on the second end thereof. The two sliding blocks 40 each have a second horizontal surface 41 located on the top end thereof to mate with the second push surface 23, and a second bevel surface 42 located on the top end thereof to mate with the first bevel surface 32 of the respective sliding bar 30. A bump 43 is disposed at one side of the second horizontal surface 41. The bump 43 has a top end thereof forming the second bevel surface 42. The first bevel surface 32 and the second bevel surface 42 are 45° bevel surfaces.

As illustrated in FIG. 2 and FIG. 3, the button holes 14 on the two opposite ends of the grip body 10 are through holes at an obliquely upward 45-degree angle. The press button 20 is disposed in the respective button hole 14 at 45-degree angle. The button hole 14 is mounted with a frame 50. The press button 20 is mounted in the respective frame 50. Preferably, the frame 50 defines therein a position-limiting groove 51. The press button 20 has a position-limiting rib 24 coupled to the position-limiting groove 51.

Figure 11:
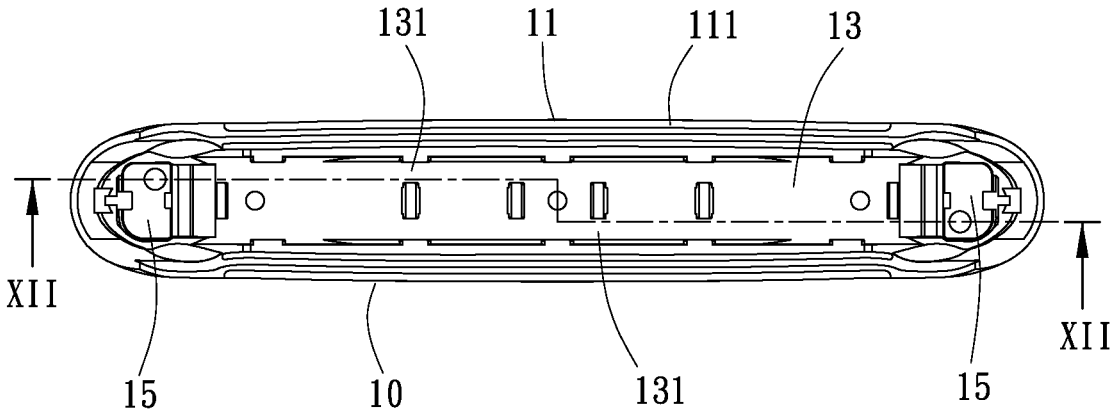
FIG. 11 is a schematic top view of the present invention, illustrating the internal structure of the lower half of the grip body.
Figure 12:
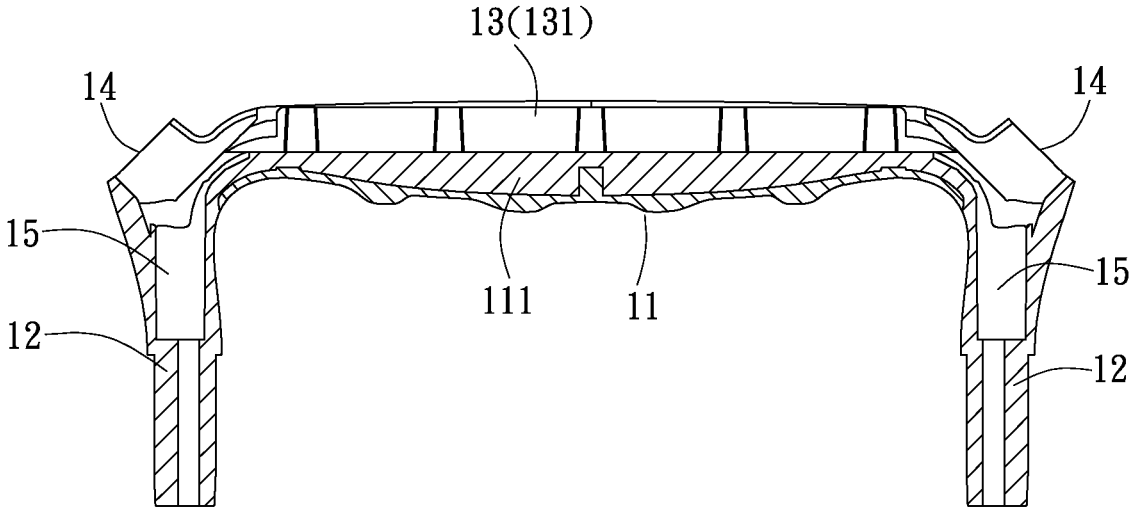
FIG. 12 is a sectional view taken along line XII-XII of FIG. 11.

As illustrated in FIG. 2, FIG. 11 and FIG. 12, the horizontal grip bar 11 of the grip body 10 consists of a lower half 111 and an upper half 112. The first internal chamber 13 is defined in between the lower half 111 and the upper half 112. The two opposite ends of the lower half 111 and the two opposite ends of the upper half 112 are fastened together to form the two button holes 14. The two opposite ends of the lower half 111 are respectively connected with the mounting bars 12. The lower half 111 defines two sliding grooves 131 in the first internal chamber 13 for the placement of the two sliding bars 20.

When the present invention is used, as shown in FIG. 9 and FIG. 10, the user can easily press the button 20 on the grip body 10 at 45°. When one of the two press buttons 20 is pressed by the user, the first push surface 22 of the pressed press button 20 pushes the first end of the respective sliding bar 30 by its component force, causing the second end of the sliding bar 30 to push the respective sliding block 40. At the same time, the second push surface 23 of the pressed press button 20 pushes the other sliding block 40 by its component force. Therefore, the two sliding blocks 40 are synchronously moved downward, causing the linkage rods 101 to move the locking mechanisms in the respective retractable bars 100 for allowing adjustment of the length of the retractable bars 100.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dual-button handle grip joined to respective top ends of two retractable bars of a luggage, comprising:

a grip body comprising a horizontal grip bar and two mounting bars respectively connected to two opposite ends of said horizontal grip bar, said horizontal grip bar having a first internal chamber defined therein and two button holes respectively obliquely located on two opposite ends thereof in communication with said first internal chamber, said mounting bars being respectively mounted to the top ends of the respective said retractable bars, each said mounting bar defining therein a second internal chamber in communication with said first internal chamber;

two press buttons respectively movably mounted in said button holes, said press buttons having respective bottom ends thereof respectively inserted into said first internal chamber, each said press button comprising a push block located on a bottom end thereof, said push block comprising a first push surface facing said first internal chamber and a second push surface facing the said second internal chamber of the respective said mounting bar;

two sliding bars horizontally slidably mounted in said first internal chamber, each said sliding bar having a first end thereof abutted against the said first push surface of one respective said press button and a second end thereof; and two sliding blocks respectively and vertically slidably mounted in the said second internal chambers of the respective said mounting bars, each said sliding block having a top end thereof respectively abutted against the second end of one respective said sliding bar and the said second push surface of one respective said press button and a bottom end thereof respectively connected to a respective linkage rod in one respective said retractable bar, wherein when one of said two press buttons is pressed by an external force, said first push surface of the pressed said press button pushes the first end of the respective said sliding bar, causing the second end of the moved said sliding bar to push the respective said sliding block, and the second push surface of the pressed said press button pushes the other said sliding block, and thus, the two said sliding blocks are synchronously moved downward to drive the respective said linkage rods.

2. The dual-button handle grip as claimed in claim 1, wherein said first push surface is a first vertical surface parallel to the vertical center line of said grip body; said second push surface is a first horizontal surface perpendicular to the vertical center line of said grip body.

3. The dual-button handle grip as claimed in claim 2, wherein the first end of each said sliding bar provides a second vertical surface mating with said first push surface of said push block of one respective said press button; the second end of each said sliding bar provides a first bevel surface; the top end of each said sliding block provides a second horizontal surface mating with said second push surface of said push block of one respective said press button, and a second bevel surface mating with said first bevel surface of one respective said sliding bar.

4. The dual-button handle grip as claimed in claim 3, wherein each said sliding block comprises a bump disposed at one side of the said second horizontal surface thereof, said bump having a top end thereof forming the said second bevel surface.

5. The dual-button handle grip as claimed in claim 4, wherein said first bevel surface and said second bevel surface are 45° bevel surfaces.

6. The dual-button handle grip as claimed in claim 1, wherein said button holes on the two opposite ends of said grip body are through holes at an obliquely upward 45-degree angle; said press buttons are respectively disposed in the respective said button holes at a 45-degree angle.

7. The dual-button handle grip as claimed in claim 1, wherein said horizontal grip bar consists of a lower half and an upper half, said lower half and said upper half defining said first internal chamber therebetween, said lower half and said upper half having respective two opposite ends thereof fastened together to form said button holes, said lower half having the two opposite ends thereof respectively connected with said mounting bars.

8. The dual-button handle grip as claimed in claim 7, wherein said lower half defines two sliding grooves in said first internal chamber for accommodating said sliding bars respectively.

9. The dual-button handle grip as claimed in claim 8, wherein each said button hole is respectively mounted with a frame; said two press buttons are respectively mounted in the said two frames.

10. The dual-button handle grip as claimed in claim 9, wherein each said frame has a position-limiting groove defined therein; each said press button comprises a position-limiting rib coupled to the said position-limiting groove of one respective said frame.

* * * * *